US007017487B2

(12) United States Patent
Hoffmann et al.

(10) Patent No.: US 7,017,487 B2
(45) Date of Patent: Mar. 28, 2006

(54) RUBBER BLANKET WITH A METAL OR PLASTIC CARRIER PLATE

(75) Inventors: Eduard Hoffmann, Bobingen (DE); Alfons Grieser, Sielenbach (DE); Thomas Kandlbinder, Augsburg (DE)

(73) Assignee: MAN Roland Druckmashchinen AG, Offenbach am Main (DE)

( * ) Notice: Subject to any disclaimer, the term of this patent is extended or adjusted under 35 U.S.C. 154(b) by 0 days.

(21) Appl. No.: 11/015,094

(22) Filed: Dec. 17, 2004

(65) Prior Publication Data

US 2005/0183596 A1 Aug. 25, 2005

(30) Foreign Application Priority Data

Dec. 19, 2003 (DE) ..... 103 60 014

(51) Int. Cl.
*B41F 13/10* (2006.01)
*B41F 27/06* (2006.01)

(52) U.S. Cl. ..... 101/376; 101/375; 101/217

(58) Field of Classification Search ..... 101/375, 101/217, 376
See application file for complete search history.

(56) References Cited

U.S. PATENT DOCUMENTS 6,530,321 B1 * 3/2003 Andrew et al. ..... 101/376
6,640,705 B1 * 11/2003 Stuhlmiller et al. ..... 101/217
2001/0032560 A1 * 10/2001 Andrew et al. ..... 101/376

* cited by examiner

*Primary Examiner*—Andrew H. Hirshfeld
*Assistant Examiner*—Marissa Ferguson
(74) *Attorney, Agent, or Firm*—Leydig, Voit & Mayer, Ltd.

(57) ABSTRACT

A rubber blanket for covering a transfer cylinder of a printing machine is provided. The transfer cylinder includes a cylinder channel for receiving an end of the rubber blanket to secure the rubber blanket to the transfer cylinder. The rubber blanket includes a rigid carrier plate and a plurality of layers that are arranged on the carrier plate. The plurality of layers include a cover layer, a non-expandable layer arranged underneath the cover layer and at least one other layer. A first end portion of the rubber blanket is adapted for insertion into a cylinder channel. The cover layer and the non-expandable layer extend into the first end portion and the at least one other layer does not extend into the first end portion such that when the rubber blanket is secured to a transfer cylinder the cover layer and the non-expandable layer are inserted into the cylinder channel and the at least one other layer is not inserted into the cylinder channel.

8 Claims, 1 Drawing Sheet

RUBBER BLANKET WITH A METAL OR PLASTIC CARRIER PLATE

FIELD OF THE INVENTION

The present invention relates to a rubber blanket with a metal or plastic carrier plate consisting of several layers, particularly for covering a transfer cylinder of an offset printing machine.

BACKGROUND OF THE INVENTION

It is generally known to mount rubber blankets on transfer cylinders, which are also called rubber blanket cylinders. Typically, the ends of the rubber blanket are inserted into the tensioning channels or cylinder pits of the transfer cylinder and fixed in place. To minimize the channel width, recently rubber blankets have been used that consist of a multi-layer structure. The layers include a cover layer that can be inked and that can contact a print carrier (e.g., a paper web) for transferring a print image. In addition, compressible layers and non-expandable layers are used. The compressible layers can be materials with air inclusions and the non-expandable layers are typically woven cloth or textile layers. It is advantageous to arrange a non-expandable layer underneath the printing cover layer and to arrange a compressible layer underneath the non-expandable layer. However, other layer sequences can also be used. Multiple compressible and non-expandable layers can also be used.

With known rubber printing blankets having rigid carrier plates (which are referred to as metal backed rubber blankets), there is a risk that individual layers may detach from the carrier plate during the printing process due to forces in the channel region if only the ends not that are not covered by the rubber layer structure are inserted into the cylinder channel. In particular, there is the risk that the printing cover layer will separate.

A printing blanket is disclosed in DE 101 17 409 A1 that has a rubber layer of consisting of several layers and where at least one end of the rubber blanket is sealed. The seal extends through the entire material thickness of the rubber layer structure and also partially covers the free ends of the metal layer or carrier plate introduced into the cylinder pit due to its somewhat triangular cross section. This arrangement, in particular, prevents fluids from penetrating the textile intermediate layer or from causing a separation of the topmost layer by getting under the topmost layer during the printing process. Due to extreme stresses or very high forces on the rubber blanket ends, the seal can be damaged leading to separation of individual layers. This can considerably shorten the life of such rubber blankets in comparison to conventional rubber blankets that do not have rigid carrier layers.

BRIEF SUMMARY OF THE INVENTION

In view of the foregoing, an object of the invention is to provide a rubber blanket having a rigid carrier plate, particularly a metallic carrier plate, that prevents penetration of fluids at the ends of the rubber layer and considerably reduces the risk of lifting of various layers at the ends of the rubber layer structure. Moreover, the required channel width for the rubber blanket of the invention is considerably smaller in comparison with the channel widths required for conventional rubber blankets.

DETAILED DESCRIPTION OF THE INVENTION

Figure 1:
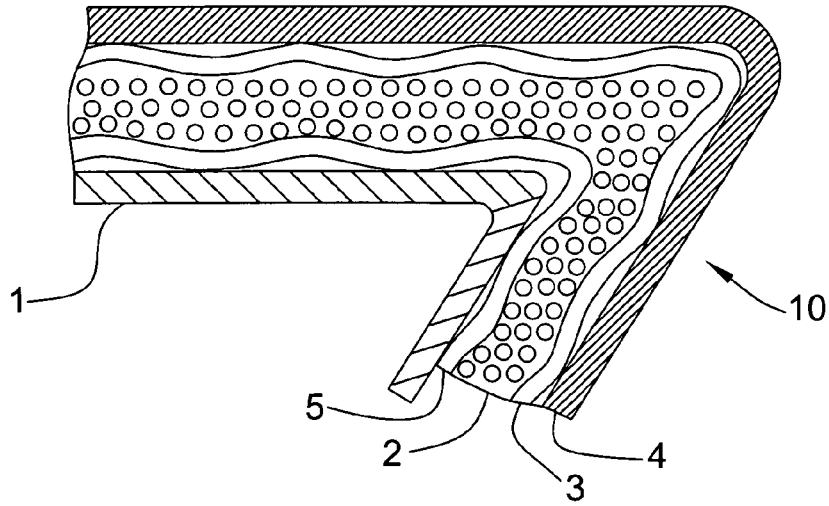
FIG. 1 is a side view of one end of an exemplary rubber blanket having a rigid carrier plate.

Referring now to the drawings, FIG. 1 illustrates a rubber blanket having a rigid carrier plate 1. Preferably, a metal material is used for this carrier plate, e.g. a conventional sheet-metal plate can be used. Typically, a compressible layer 2 is arranged above the carrier plate and a non-expandable layer, which can consist of individual threads or a textile layer 3, is used above the compressible layer 2 as a non-expandable intermediate layer. A cover layer 4, (i.e., the printing layer of the rubber blanket 10) is arranged on the textile layer 3. The cover layer contacts a print carrier (not shown) for the purpose of transferring the print image. In the embodiment shown in FIG. 1, another textile intermediate layer or textile layer 5 is used underneath the compressible layer 2 in order to optimize the expansion behavior of the layer structure. As will be appreciated by those skilled in the art, the present invention includes rubber blankets having a different layer structure. For example, rubber blankets according to the invention can have layer sequences other than what is shown in FIG. 1 or and a different number of layers can be used.

In FIG. 1, the rubber blanket 10 is shown with its carrier plate in an offset arrangement. The offset is provided to assist fixing the ends of the rubber blanket on a rubber blanket cylinder (offset cylinder). If the ends of the rubber blanket are offset to the carrier plate in the way shown in FIG. 1, then a relatively large channel width in the rubber cylinder is required, particularly when both ends of the rubber blanket 10 are offset in the manner shown in FIG. 1.

According to an important aspect of the present invention, only a portion of the layers on the carrier plate 1 are offset and inserted together with the ends of the carrier plate 1 into the channel of the rubber cylinder. For example, in FIG. 2, the bottom textile layer 5 does not extend into the offset portion. By only extending a portion of the layers on the carrier plate into the offset portion, it is possible to reduce the channel width of the rubber blanket cylinder in comparison with the arrangement shown in FIG. 1 without any adverse affects. In particular, there is no risk of moisture penetrating the rubber blanket layer structure or premature separation of the individual layers in the end region of the rubber blanket 10.

Figure 2:
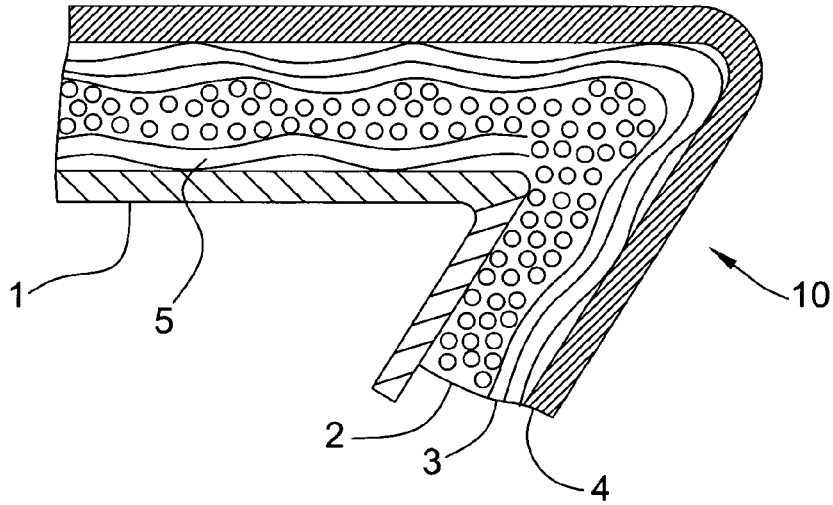
FIG. 2 is a side view of one end of an exemplary rubber blanket having a rigid carrier plate according to the invention.
Figure 3:
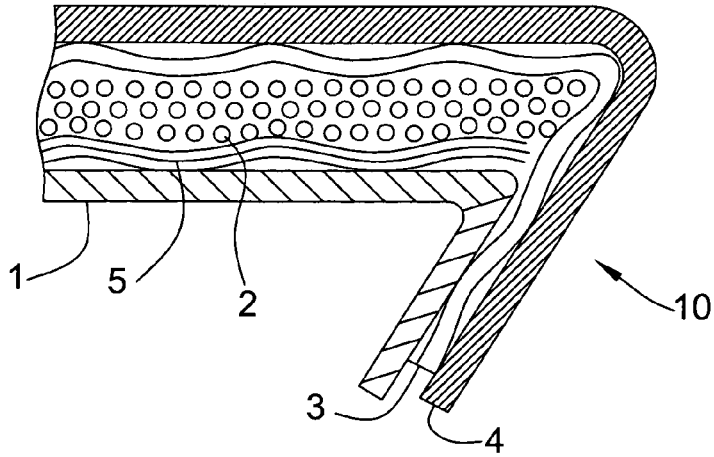
FIG. 3 is a side view of one end of another embodiment of a rubber blanket having a rigid carrier plate according to the invention.

A particularly advantageous and preferred embodiment of the invention is shown in FIG. 3. FIG. 3 illustrates a rubber blanket 10 with a carrier plate 1 on which a bottom textile layer 5 is arranged, above which a compressible layer 2 is arranged. Another textile layer is arranged on the compressible layer 2, and finally the printing cover layer 4 is arranged on the top. Thus, the basic layer structure of the rubber blanket 10 in FIG. 3 does not differ from the layer structure of the rubber blankets 10 shown in FIGS. 1 and 2. The significant difference in the FIG. 3 embodiment is that only the cover layer 4 and the textile layer 3 arranged underneath the cover layer extend nearly up to the end of the carrier plate 1, while the compressible layer 2 and the cover layer 5 only extend up to the start of the offset portion. This is in contrast to the arrangements of FIGS. 1 and 2 where the compressible layer 2 and the cover layer 5 also extend into the offset portion. Therefore, only the relatively thin cover layer 4 and the relatively thin top compressible layer 3 together with the ends of the carrier plate 1 in offset portion have to be inserted into and the cylinder channel and fixed in place. It is advantageously possible to configure only one end of the rubber blanket 10 according to the invention. Preferably, the end configured according to the invention is the so-called leading end of the rubber blanket, which is known to be the most critical in terms of damage to the rubber blanket layer structure. However, the second end (i.e., the so-called following end) can also be configured according to the invention and in this form fixed together with the leading end in the cylinder channel.

From the preceding description and FIGS. 1–3, it can be seen that the configuration of the rubber blanket 10 according to FIG. 2 enables the channel of a transfer cylinder to be considerably narrower than the arrangement shown in FIG. 1. The channel width can be even smaller when the configuration of FIG. 3 is used on one end of the rubber blanket, preferably the leading end of the rubber blanket, and the other end (i.e., the following end) has the configuration shown in FIG. 1.

However, it is also possible to configure the leading end of the rubber blanket according to FIG. 3 and the following end according to the state of the art mentioned in the background of the invention section. More specifically, the carrier plate can be beveled and inserted into the cylinder channel, while the other layers, including the cover layer, are shorter so that they are not inserted into the cylinder channel. In such a case, a seal according to the state of the art is preferable. However, with such an arrangement, there is still the risk that despite sealing, liquids could penetrate the layer structure at the following end of the rubber blanket. However, this arrangement provides a good compromise as compared to the layer structure according to the prior art. In particular, because using the configuration of invention at the leading edge of the rubber blanket eliminates the most critical risks, the rubber blanket life can be significantly lengthened.

The cover layer can consist of rubber or polyurethane or comparable materials. The textile layer can consist of hard rubber or polyurethane or comparable materials. The compressible layer can consist of rubber, polyurethane or comparable materials. The carrier layer can consist of metallic or non-metallic materials. The layer structure on the rubber blanket can also include a coating that can consist of a PET film, comparable films, rubber film, polyurethane, lacquer, or comparable materials.

What is claimed is:

1. A rubber blanket for covering a transfer cylinder of a printing machine, the transfer cylinder including a cylinder channel for receiving an end of the rubber blanket to secure the rubber blanket to the transfer cylinder, the rubber blanket comprising:

a rigid carrier plate; and a plurality of layers arranged on the carrier plate, the plurality of layers including a cover layer, a non-expandable layer arranged underneath the cover layer and at least one other layer;

a first end portion of the rubber blanket being adapted for insertion into a cylinder channel and wherein the cover layer and the non-expandable layer extend into the first end portion and the at least one other layer does not extend into the first end portion such that when the rubber blanket is secured to a transfer cylinder the cover layer and the non-expandable layer are inserted into the cylinder channel and the at least one other layer is not inserted into the cylinder channel.

2. A rubber blanket according to claim 1, wherein the first end portion of the rubber blanket has an offset configuration and the cover layer and the non-expandable layer extend into the offset first end portion and are insertable together with the carrier plate into the cylinder channel and wherein the at least one other layer comprises a compressible layer that ends before reaching the offset first end portion.

3. A rubber blanket according to claim 2, wherein the compressible layer consists of a rubber or a polyurethane material.

4. A rubber blanket according to claim 1, wherein the plurality of layers includes a compressible layer and the first end portion of the rubber blanket has an offset configuration and the cover layer, the non-expandable layer and the compressible layer extend into the offset first end portion and are insertable together with the carrier plate into the cylinder channel and wherein the at least one other layer comprises a bottom carrier layer that ends before reaching the offset first end portion.

5. A rubber blanket according to claim 4, wherein the bottom carrier layer consists of metallic or non-metallic materials.

6. A rubber blanket according to claim 1, wherein the cover layer consists of a rubber or a polyurethane material.

7. A rubber blanket according to claim 1, wherein the non-expandable layer consists of a hard rubber or polyurethane material.

8. A rubber blanket according to claim 1, wherein the plurality of layers includes a coating that consists of a PET film, rubber film, polyurethane material or lacquer material.

* * * * *